US012662957B2

(12) United States Patent
Yageta

(10) Patent No.: US 12,662,957 B2
(45) Date of Patent: Jun. 23, 2026

(54) COOLING DEVICE

(71) Applicant: HONDA MOTOR CO., LTD., Tokyo (JP)

(72) Inventor: Tomoaki Yageta, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/578,603

(22) Filed: Jan. 19, 2022

(65) Prior Publication Data

US 2022/0228822 A1 Jul. 21, 2022

(30) Foreign Application Priority Data

Jan. 21, 2021 (JP) ..... 2021-007886

(51) Int. Cl.

| | |
|---|---|
| ***F01P 11/06*** | (2006.01) |
| ***B63B 49/00*** | (2006.01) |
| ***B63H 21/38*** | (2006.01) |
| ***F01P 3/20*** | (2006.01) |

(52) U.S. Cl.

CPC ..... *F01P 11/06* (2013.01); *B63B 49/00* (2013.01); *B63H 21/38* (2013.01); *F01P 3/205* (2013.01)

(58) Field of Classification Search

CPC ..... F01P 11/06; F01P 3/205; B63B 49/00; B63H 21/38

USPC ..... 440/88 N

See application file for complete search history.

(56) References Cited

U.S. PATENT DOCUMENTS

2012/0042855 A1* 2/2012 Vogely ..... F02M 37/0052 123/498
2018/0157701 A1* 6/2018 Hiroki ..... G06F 16/2379

FOREIGN PATENT DOCUMENTS

| | | | | | |
|---|---|---|---|---|---|
| CN | 102320674 | A | * | 1/2012 | |
| CN | 110217846 | A | * | 9/2019 | ..... C02F 1/06 |
| JP | 2018132213 | A | * | 8/2018 | |
| JP | 2020-078956 | | | 5/2020 | |
| JP | 2020-180583 | | | 11/2020 | |
| KR | 20180006067 | A | * | 1/2018 | ..... F02B 29/0437 |

* cited by examiner

*Primary Examiner* — Lindsay M Low
*Assistant Examiner* — Omar Morales
(74) *Attorney, Agent, or Firm* — Amin, Turocy & Watson, LLP

(57) ABSTRACT

A cooling device includes a refrigerant flow path provided in a propulsion system of a ship; an electric pump configured to cause a refrigerant or a cleaning medium to flow through the refrigerant flow path; and a control unit configured to control operations of the propulsion system and the electric pump. The control unit executes each of a plurality of operating modes including a first operating mode (normal operating mode) which drives the propulsion system and the electric pump and causes the refrigerant to flow through the refrigerant flow path, and a second operating mode (maintenance mode) which drives the electric pump without driving the propulsion system and causes the cleaning medium to flow through the refrigerant flow path.

4 Claims, 4 Drawing Sheets

COOLING DEVICE

CROSS-REFERENCE TO RELATED APPLICATION

Priority is claimed on Japanese Patent Application No. 2021-007886, filed Jan. 21, 2021, the content of which is incorporated herein by reference.

BACKGROUND OF THE INVENTION

Field of the Invention

The present invention relates to a cooling device.

Description of Related Art

For example, Japanese Unexamined Patent Application, First Publication No. 2020-180583 discloses a ship propeller that supplies cooling water to a cooling circuit of an internal combustion engine, by a water pump driven by a drive shaft directly connected to a crank shaft of the internal combustion engine for ship propulsion.

For example, Japanese Unexamined Patent Application, First Publication No. 2020-78956 discloses a system which performs flushing of seawater into a cooling circuit by supplying cleaning water to a cooling water channel of an internal combustion engine of a ship propeller. This system includes a flushing pump, a plurality of solenoid valves, and the like, in addition to a water pump that takes in seawater for cooling to the cooling circuit.

SUMMARY OF THE INVENTION

When a water pump connected to an internal combustion engine for ship propulsion is provided, as in the above-mentioned conventional ship propeller, it is necessary to drive the internal combustion engine even when performing flushing for cleaning the inside of the cooling circuit, and there arises a problem that it is difficult to control energy consumption.

When a dedicated pump for flushing, a plurality of solenoid valves, and the like are provided in addition to the pump for refrigerant distribution as in the above-mentioned conventional system, there arises a problem that the system configuration becomes complicated.

An aspect according to the present invention has been made in view of the above points, and an object of the present invention is to provide a cooling device capable of minimizing energy consumption, while minimizing complication of a configuration.

In order to solve the above problems and achieve the above object, the present invention has adopted the following aspects.

(1) A cooling device according to an aspect of the present invention includes a refrigerant flow path provided in a propulsion system of a ship; an electric pump configured to cause a refrigerant or a cleaning medium to flow through the refrigerant flow path; and a control unit configured to control operations of the propulsion system and the electric pump, in which the control unit operates in each of a plurality of operating modes including a first operating mode in which the propulsion system and the electric pump are driven and the refrigerant is caused to flow through the refrigerant flow path, and a second operating mode in which the electric pump is driven without driving the propulsion system and the cleaning medium is caused to flow through the refrigerant flow path.

(2) In the above aspect (1), the cooling device may include a power storage device configured to supply electric power to the electric pump, in which the control unit may control a driving time of the electric pump depending on a residual capacity of the power storage device when the second operating mode is executed.

(3) In the above aspect (2), the control unit may prohibit driving of the electric pump, in a case in which the residual capacity of the power storage device is equal to or less than a predetermined value when the second operating mode is in operation.

(4) In any one of the above aspects (1) to (3), the cooling device may further include a display device controlled by the control unit, in which, when the second operating mode is in operation, the control unit may display information indicating that the second operating mode is in operation and information about a driving time of the electric pump, on the display device.

According to the above aspect (1), it is possible to minimize energy consumption, by including a control unit that operates in a second operating mode in which the cleaning medium is caused to flow through the refrigerant flow path by driving the electric pump without driving the propulsion system, in contrast to a case of driving the entire system when cleaning the refrigerant flow path.

In the case of the above aspect (2), it is possible to perform more appropriate cleaning uniformly and efficiently, by including the control unit that controls the driving time of the electric pump depending on the residual capacity of the power storage device, for example, as compared with a case where an operator performs cleaning over an appropriate time.

In the case of the above aspect (3), it is possible to inhibit stopping of the cooling device in an insufficiently cleaned state, by including the control unit that prohibits driving of the electric pump when the residual capacity of the power storage device is equal to or less than a predetermined value.

In the case of the above aspect (4), it is possible to improve the convenience for the operator, by including the control unit which displays information indicating that the second operating mode is in operation and information about the driving time of the electric pump on the display device.

DETAILED DESCRIPTION OF THE INVENTION

Hereinafter, a cooling device 10 according to the embodiment of the present invention will be described with reference to the attached drawings.

Figure 1:
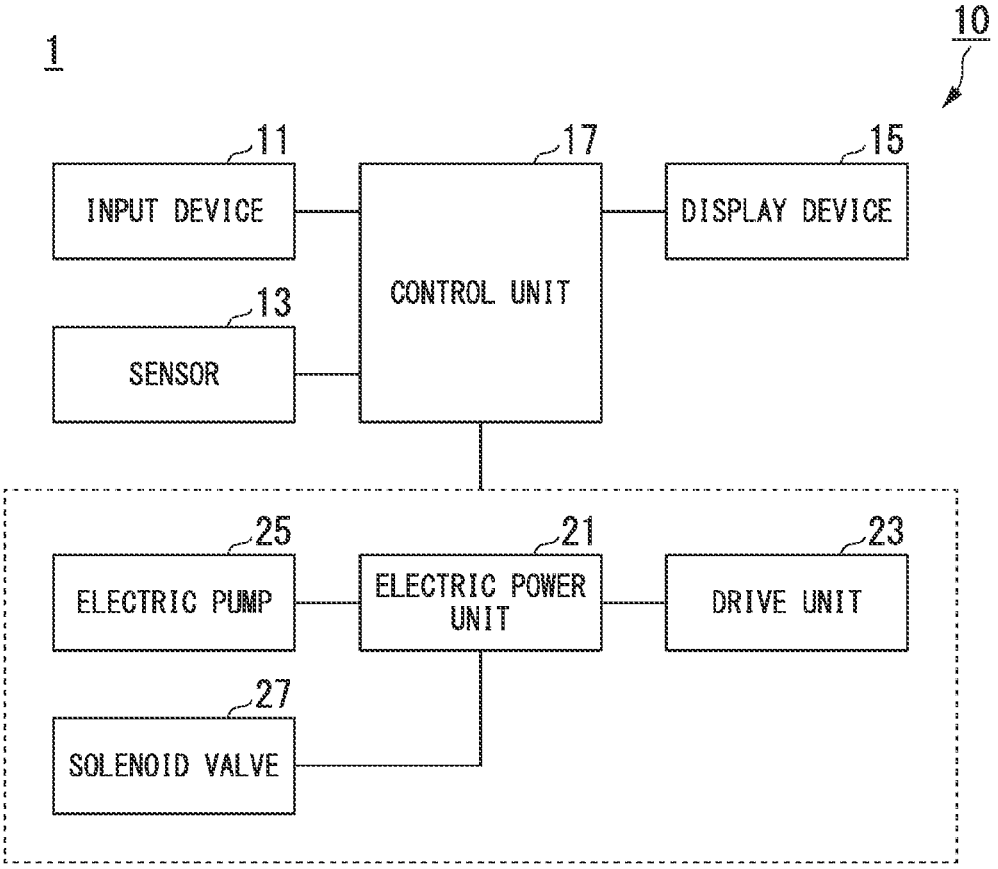
FIG. 1 is a configuration diagram of a ship equipped with a cooling device according to an embodiment of the present invention.
Figure 2:
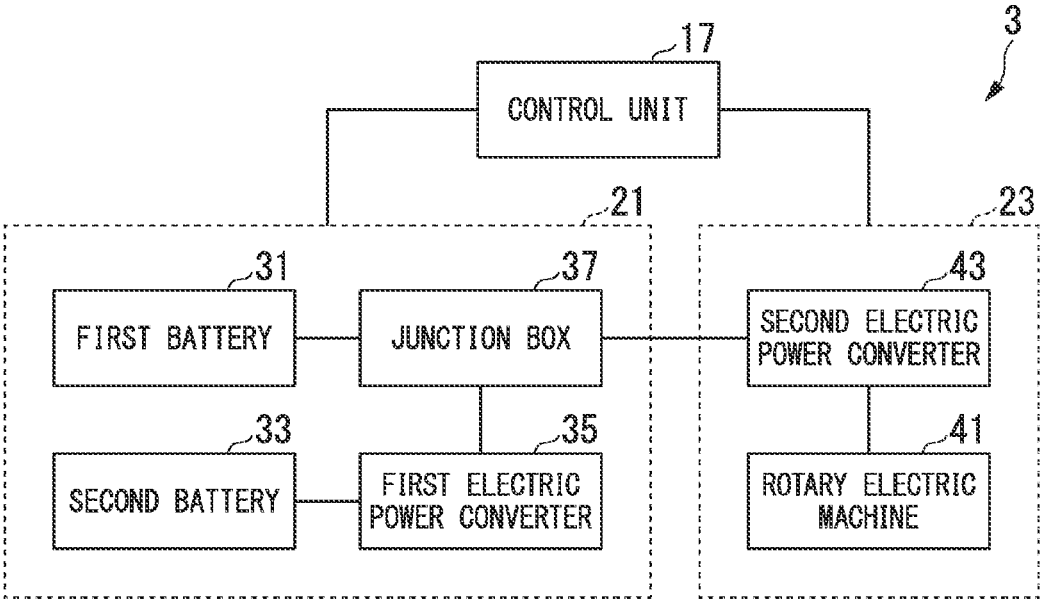
FIG. 2 is a configuration diagram of a ship propulsion system according to an embodiment of the present invention.

FIG. 1 is a configuration diagram of a ship 1 equipped with the cooling device 10 in the embodiment. FIG. 2 is a configuration diagram of a propulsion system 3 of a ship 1 in the embodiment.

<Ship 1>

The cooling device 10 according to the present embodiment is mounted on a ship 1, for example, such as an electric propulsion ship. A power source of the electric propulsion vessel is, for example, a power storage device, a power storage device and an internal combustion engine, a fuel cell, or the like.

As shown in FIG. 1, the ship 1 includes, for example, an input device 11, a sensor 13, a display device 15, a control unit 17, an electric power unit 21, a drive unit 23, an electric pump 25, and a solenoid valve 27. In the above configuration, for example, at least a part of the electric power unit 21 and the drive unit 23 form the propulsion system 3 of the ship 1. The above configurations, except for the drive unit 23, form the cooling device 10.

The input device 11 receives various operations of the operator and outputs signals corresponding to the various operations to the control unit 17. The input device 11 is, for example, a switch, a steering wheel, a lever, a joystick, a touch panel, or the like.

For example, various switches and buttons may output a signal which instructs switching between supply of electric power being turned on or off to a part or the whole of the ship 1, switching to starting in a normal operating mode with starting and stopping of the entire system of the ship 1, and switching to starting in a maintenance mode, which will be described later, and the like. For example, the steering wheel outputs a signal for instructing steering of the ship 1. For example, the lever and the joystick output a signal indicating the direction and output of the propulsive force. For example, the touch panel outputs command signals such as execution instructions for various operations.

The sensor 13 detects various state quantities of the ship 1 and outputs a signal of the detection results to the control unit 17. The sensor 13 includes, for example, a sensor that detects state amounts (a temperature, a voltage, a current, etc.) of a high-voltage first battery (a storage device) 31 of an electric power unit 21, which will be described below, a sensor that detects state amounts (a rotational speed, a current, etc.) of a rotary electric machine 41 of the drive unit 23, and the like that.

The display device 15 is, for example, a touch panel or the like that accepts an operator's input operation.

The control unit 17 controls, for example, the entire ship 1 in an integrated manner. The control unit 17 is a software functional unit that functions by executing a predetermined program using a processor such as a central processing unit (CPU). The software functional unit may be an electronic control unit (ECU) which is equipped with a processor such as a CPU, a read only memory (ROM) for storing programs, a random access memory (RAM) for temporarily storing data, and an electronic circuit such as a timer. At least a part of the control unit 17 may be an integrated circuit such as a large scale integration (LSI).

The control unit 17 cooperatively controls, for example, an ECU provided in each of the electric power unit 21 and the drive unit 23.

As shown in FIG. 2, the electric power unit 21 includes, for example, at least one high-voltage first battery 31 which is a power source of the ship 1, a low-voltage second battery 33 such as that of a 12 V type, a first electric power converter 35 such as a DC-DC converter which performs stepping-down and boosting of a DC voltage, a junction box 37 having a relay, a fuse, and the like, and an ECU (not shown).

For example, the high-voltage first battery 31 is connected to the first electric power converter 35 and a second electric power converter 43 of the drive unit 23 via the junction box 37. The low-voltage second battery 33 is connected to the junction box 37 via the first electric power converter 35.

The drive unit 23 is, for example, an outboard engine, an inboard and outboard engine, an inboard engine, or the like. The drive unit 23 includes, for example, at least one rotary electric machine 41 for propulsion, a second electric power converter 43 such as an inverter that converts electric power between direct current and alternating current, a transmission (not shown), a propeller (not shown), and an ECU (not shown).

For example, the rotary electric machine 41 for propulsion is driven by the electric power supply from the second electric power converter 43. A drive shaft of the rotary electric machine 41 is connected to the propeller via the transmission.

<Cooling Device 10>

The electric pump 25 and the solenoid valve 27 of the cooling device 10 are driven by the electric power supply from the electric power unit 21.

Figure 3:
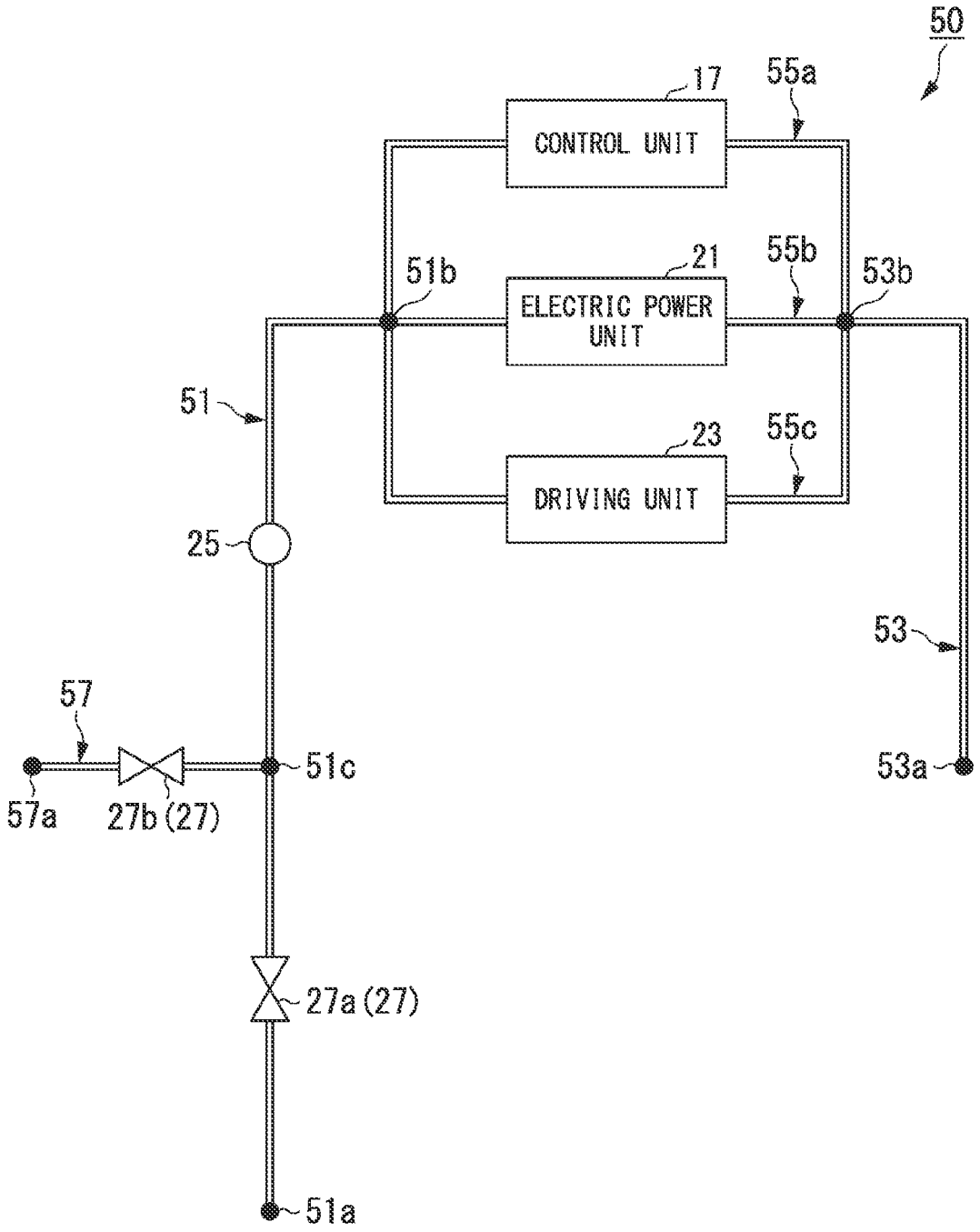
FIG. 3 is a configuration diagram of a refrigerant flow path of a cooling device according to an embodiment of the present invention.

FIG. 3 is a block diagram of a refrigerant flow path 50 of the cooling device 10 in the embodiment.

As shown in FIG. 3, the electric pump 25 and the solenoid valve 27 are disposed in the refrigerant flow path 50 of the cooling device 10.

The refrigerant flow path 50 includes, for example, a refrigerant supply path 51, a refrigerant discharge path 53, a first refrigerant flow path 55*a* connected to the control unit 17, a second refrigerant flow path 55*b* connected to the electric power unit 21, a third refrigerant flow path 55*c* connected to the drive unit 23, and a cleaning flow path 57.

The refrigerant supply path 51 includes, for example, a water intake unit 51*a*, a first branch unit 51*b*, a connection unit 51*c*, a first solenoid valve 27*a* (27), and an electric pump 25.

The water intake unit 51*a* is provided at a first end portion of the two ends of the refrigerant supply path 51. An intake port that opens in the water around the ship 1 is formed in the water intake unit 51*a*. The water intake unit 51*a* takes in the refrigerant to the refrigerant flow path 50 by the action of the electric pump 25 when the normal operating mode is in operation. The first branch unit 51*b* is provided at a second end portion among both ends of the refrigerant supply path 51. The first branch unit 51*b* is connected to the first end portion of each of the first refrigerant flow path 55*a*, the second refrigerant flow path 55*b*, and the third refrigerant flow path 55*c*.

The connection unit 51*c* is provided between the water intake unit 51*a* and the first branch unit 51*b*. The connection unit 51*c* is connected to the cleaning flow path 57.

The first solenoid valve 27*a* is disposed between the water intake unit 51*a* and the connection unit 51*c*. The first solenoid valve 27*a* switches between being open and closed according to the control of the control unit 17. For example, the first solenoid valve 27*a* is in an open state in the normal operating mode (a first operating mode) for driving the propulsion system 3. The first solenoid valve 27*a* is in a closed state in the maintenance mode (a second operating mode: a wake-up mode) in which the propulsion system 3 is not driven.

The electric pump 25 is disposed between the branch unit 51*b* and the connection unit 51*c*. The electric pump 25 is driven depending on the control of the control unit 17. For example, in the normal operating mode, the electric pump 25 distributes a refrigerant such as seawater or fresh water around the ship 1 taken in from the water intake unit 51*a* to the refrigerant flow path 50. In the maintenance mode, the electric pump 25 distributes a cleaning medium such as cleaning water taken in from the supply unit 57*a*, which will be described later, to the refrigerant flow path 50.

The refrigerant discharge path 53 includes, for example, a drainage unit 53*a* and a second branch unit 53*b*.

The drainage unit 53*a* is provided at the first end portion among both ends of the refrigerant discharge path 53. The drainage unit 53*a* is formed with a drainage port that opens outside the ship 1.

The second branch unit 53*b* is provided at the second end portion among both ends of the refrigerant discharge path 53. The second branch unit 53*b* is connected to the second end portion among both ends of the first refrigerant flow path 55*a*, the second refrigerant flow path 55*b*, and the third refrigerant flow path 55*c*.

The cleaning flow path 57 includes, for example, a supply unit 57*a* and a second solenoid valve 27*b* (27).

The supply unit 57*a* is provided at the first end portion among both ends of the cleaning flow path 57. The supply unit 57*a* is formed with a supply port that opens outside the ship 1 (for example, at a position above a liquid level). The supply unit 57*a* takes in the cleaning medium into the refrigerant flow path 50 by the action of the electric pump 25 when the maintenance mode is executed. The second end portion of the supply unit 57*a* is connected to the connection unit 51*c*.

The second solenoid valve 27*b* is disposed between the second end portion among both ends of the cleaning flow path 57 and the supply unit 57*a* (first end portion). The second solenoid valve 27*b* switches between opening and closing depending on the control of the control unit 17. For example, the second solenoid valve 27*b* is in a closed state in the normal operating mode, and is in an open state in the maintenance mode.

Hereinafter, the operation of the cooling device 10 will be described.

Figure 4:
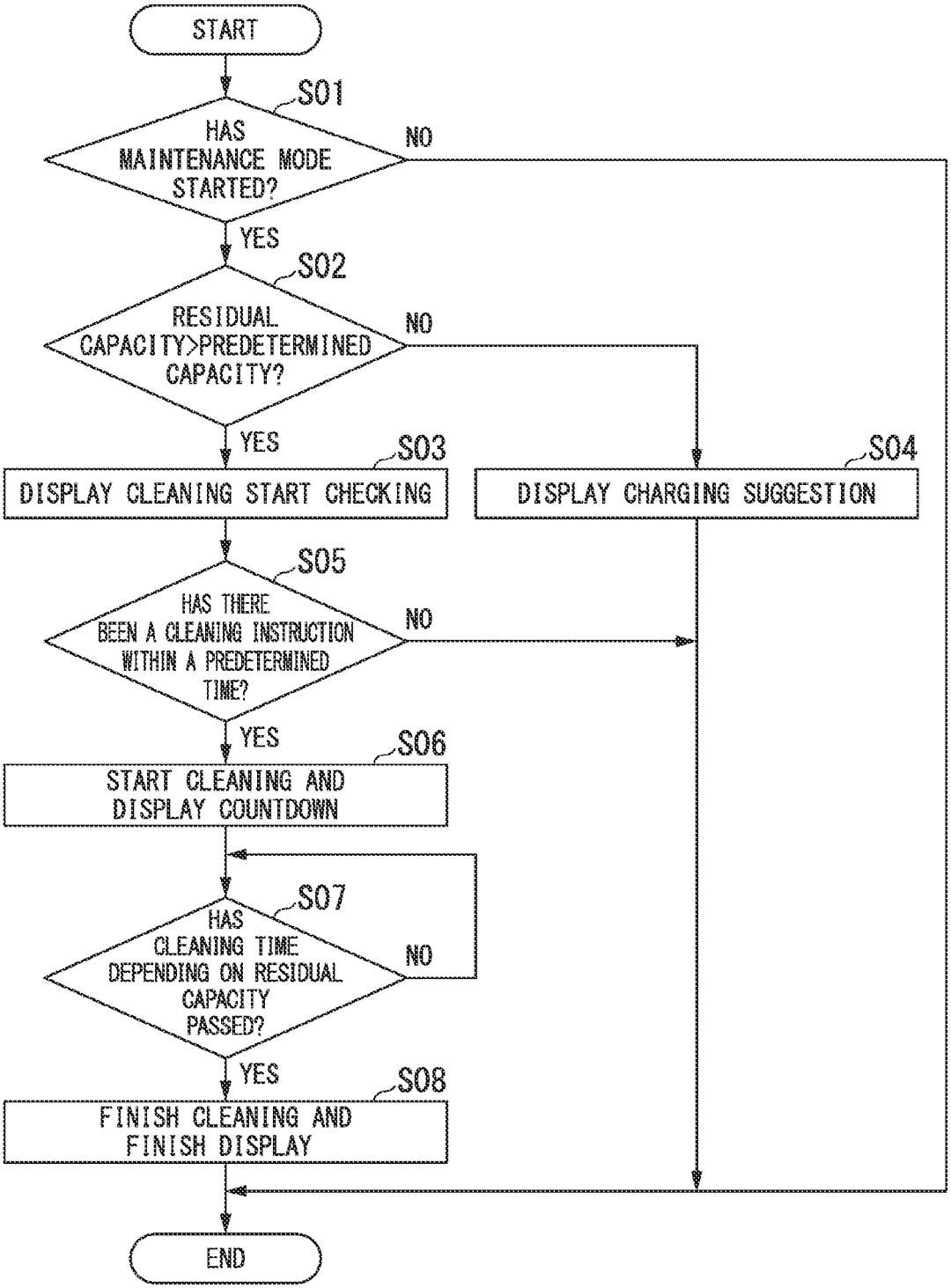
FIG. 4 is a flowchart showing the operation of the cooling device according to the embodiment of the present invention.

FIG. 4 is a flowchart showing the operation of the cooling device 10 in the embodiment.

First, as shown in FIG. 4, the control unit 17 determines whether starting of the maintenance mode has been instructed according to a predetermined operation of the operator on the input device 11 (step S01). The maintenance mode is a mode for executing a process of cleaning the refrigerant flow path 50 of the cooling device 10. The maintenance mode is started by starting supply of electric power only to the minimum equipment required for executing the process of cleaning the refrigerant flow path 50, for example, the display device 15, the electric pump 25, the solenoid valve 27, and the like.

If this determination result is "YES", the control unit 17 advances the process to step S02. On the other hand, when this determination result is "NO", the control unit 17 advances the processing to the end. Next, the control unit 17 calculates the residual capacity of the high-voltage first battery 31, on the basis of the detection signal that is output from the sensor that detects the state quantity (temperature, voltage, current, etc.) of the high-voltage first battery 31 of the electric power unit 21. The control unit 17 determines whether the calculated residual capacity is greater than the predetermined residual capacity SL (see FIG. 5) (step S02). The predetermined residual capacity SL is, for example, a threshold residual capacity at which the electric power required for performing desired cleaning of the inside of the refrigerant flow path 50 is able to be supplied. The predetermined residual capacity SL may be set, for example, to be smaller than the minimum residual capacity required for starting in the normal operating mode.

When this determination result is "YES", the control unit 17 advances the process to step S03. On the other hand, when this determination result is "NO", the control unit 17 advances the process to step S04.

Next, the control unit 17 displays predetermined information for requesting an operator to check the cleaning start on the display device 15 (step S03), and advances the process to step S05.

The control unit 17 displays a predetermined display suggesting charging of the high-voltage first battery 31 on the display device 15 (step S04), and advances the process to the end.

Next, the control unit 17 determines whether there is an instruction of the cleaning start, according to the presence or absence of a predetermined operation of the operator which is input to the input device 11 within a predetermined time from the display start of the predetermined information in step S03 described above (step S05).

When this determination result is "YES", the control unit 17 advances the process to step S06. On the other hand, when this determination result is "NO", the control unit 17 advances the process to the end. Next, the control unit 17 starts cleaning by distributing the cleaning medium in the refrigerant flow path 50 by driving of the electric pump 25 and the solenoid valve 27, and displays countdown information of the predetermined cleaning time required to perform the desired cleaning on the display device 15 (step S06). In the maintenance mode, the cleaning medium taken in from the supply unit 57*a* flows into the refrigerant supply path 51 through the cleaning flow path 57. The cleaning medium that has flowed into the refrigerant supply path 51 is distributed to the respective refrigerant flow paths 55*a* to 55*c* by the first branch unit 51*b*, and then flows into the refrigerant discharge path 53 through the second branch unit 53*b*. The cleaning medium that has flowed into the refrigerant discharge path 53 is discharged to the outside of the refrigerant flow path 50 through the drainage unit 53*a*.

Figure 5:
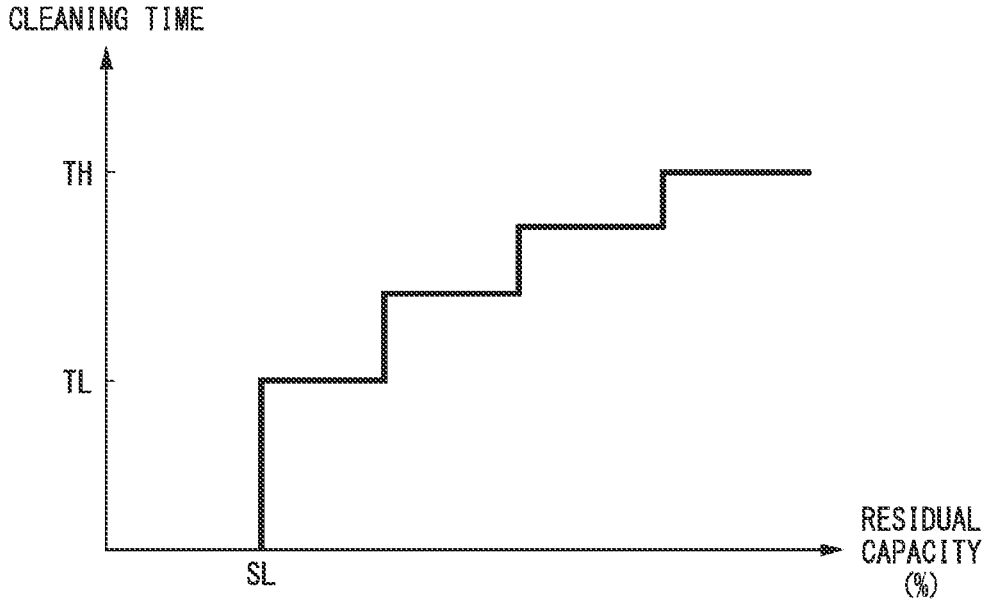
FIG. 5 is a diagram showing an example of a correspondence relationship between a cleaning time and a residual capacity of a battery in the cooling device according to the embodiment of the present invention.

Here, the predetermined cleaning time is, for example, the driving time of the electric pump 25 which is set depending on the residual capacity of the high-voltage first battery 31 of the electric power unit 21. FIG. 5 is a diagram showing an example of the correspondence between the cleaning time in the cooling device 10 and the residual capacity of the first battery 31 in the embodiment. As shown in FIG. 5, as the residual capacity of the high-voltage first battery becomes increasingly larger than the predetermined residual capacity SL, the cleaning time changes from the predetermined minimum time TL to the maximum time TH, for example, in a trend with a stepped shape or the like.

Next, as shown in FIG. 4, the control unit 17 determines whether a predetermined cleaning time has elapsed from the cleaning start (step S07).

When this determination result is "YES", the control unit 17 advances the process to the end. On the other hand, when this determination result is "NO", the control unit 17 repeatedly executes the determination process in step S07.

Next, the control unit 17 finishes cleaning of the refrigerant flow path 50 and displays information of the cleaning completion on the display device 15 (step S08). The control unit 17 ends the execution of the maintenance mode, and stops the electric power supply to the display device 15, the electric pump 25, the solenoid valve 27, and the like (shutdown). Then, the process proceeds to the end.

As described above, the cooling device 10 of the embodiment can suppress energy consumption, by including the control unit 17 that executes the maintenance mode, as compared with a case where the entire propulsion system 3 is driven, for example, when cleaning the refrigerant flow path 50.

The cooling device 10 of the embodiment can perform more appropriate cleaning uniformly and efficiently, by including the control unit 17 that controls the driving time of the electric pump 25 according to the residual capacity of the first battery 31, for example, as compared with a case where an operator performs cleaning for a time appropriately set.

The cooling device 10 of the embodiment can suppress the cooling device 10 from being terminated in an insufficient cleaning state by including the control unit 17 that prohibits the driving of the electric pump 25 when the residual capacity of the first battery 31 is equal to or less than the predetermined residual capacity SL.

The cooling device 10 of the embodiment can improve the convenience of the operator, by including the control unit 17 which displays information indicating that the maintenance mode is being executed and information about the driving time of the electric pump 25 on the display device 15.

Modified Example

Hereinafter, a modified example of the embodiment will be described. The same parts as those in the above-described embodiment are designated by the same reference numerals, and the description thereof will be omitted or simplified.

In the above-described embodiment, although the refrigerant flow path 50 includes the cleaning flow path 57, the present invention is not limited thereto, and the cleaning flow path 57 may be omitted. In this case, the cleaning medium such as cleaning water may be taken into the refrigerant flow path 50 from the water intake unit 51*a* by the action of the electric pump 25. The first solenoid valve 27*a* (27) may be omitted, or the first solenoid valve 27*a* (27) may be opened in the normal operating mode and the maintenance mode.

The embodiments of the present invention are presented as examples and are not intended to limit the scope of the invention. These embodiments can be implemented in various other embodiments, and various omissions, replacements, and changes can be made without departing from the gist of the invention. These embodiments and variations thereof are included in the scope of the invention described in the claims and the equivalent scope thereof, as included in the scope and gist of the invention.

What is claimed is:

1. A cooling device comprising:

a refrigerant flow path provided in a propulsion system of a ship and cooling the propulsion system;

a refrigerant supply path configured to take seawater or fresh water around the ship as a refrigerant;

a cleaning flow path configured to take water for cleaning the refrigerant flow path as a cleaning medium;

a valve configured to switch between the refrigerant supply path and the cleaning flow path;

an electric pump configured to cause the refrigerant and the cleaning medium to flow through the refrigerant flow path;

a control unit configured to control operations of the propulsion system and the electric pump; and a power storage device configured to supply an electric power to the electric pump, wherein the control unit executes each of a plurality of operating modes by controlling the valve, the plurality of operating modes including a first operating mode which causes the refrigerant to flow through the refrigerant flow path by driving the electric pump and the propulsion system, and a second operating mode which causes the cleaning medium to flow through the refrigerant flow path by driving the electric pump and stopping the propulsion system, the cooling device further comprising:

a display device controlled by the control unit, wherein when the second operating mode is executed, the control unit displays information indicating that the second operating mode is being executed and countdown information about a residual operating time of the second operating mode depending on a residual capacity of the power storage device, on the display device.

2. The cooling device according to claim 1 wherein the control unit controls a driving time of the electric pump depending on the residual capacity of the power storage device when the second operating mode is executed.

3. The cooling device according to claim 2, wherein the control unit prohibits driving of the electric pump, in a case in which the residual capacity of the power storage device is equal to or less than a predetermined value when the second operating mode is executed.

4. The cooling device according to claim 1, further comprising:

a connection unit configured to connect the refrigerant supply path and the cleaning flow path;

wherein the valve includes a first valve which is disposed between a water intake unit and the connection unit and a second valve which is disposed between the cleaning flow path and the connection unit, and wherein each of the first operating mode and the second operating mode is executed by the control unit switching between an opening and a closing of the first valve and the second valve.

* * * * *